United States Patent [19]

Seaman

[11] 4,068,695

[45] Jan. 17, 1978

[54] METHOD AND APPARATUS FOR CUTTING WOOD

[76] Inventor: J. Kenneth Seaman, Box 4013, Quesnel, B.C., Canada, V2J 3J2

[21] Appl. No.: 663,583

[22] Filed: Mar. 4, 1976

[30] Foreign Application Priority Data

Feb. 13, 1976 Canada ..... 245685

[51] Int. Cl.[2] ..... B27B 1/00; B27B 5/02

[52] U.S. Cl. ..... 144/312; 83/267; 83/411 R; 83/471.2; 83/733; 144/2 R; 144/242 R; 198/487; 269/63

[58] Field of Search ..... 83/411 R, 412, 404.1, 83/486.1, 471.2, 485, 488, 704, 36, 5; 144/326 R, 312, 2 R, 3 R, 136 R, 136 H, 3 K, 193 R, 242 R; 198/106, 107, 219; 33/174 TD

[56] References Cited

U.S. PATENT DOCUMENTS

| | | | |
|---|---|---|---|
| 1,908,713 | 5/1933 | McCarroll | 83/485 |
| 2,695,044 | 11/1954 | Miller et al. | 144/1 R X |
| 3,388,729 | 6/1968 | Edwards | 142/40 X |
| 3,448,780 | 6/1969 | Hervey | 83/704 |
| 3,920,058 | 11/1975 | Walker | 144/242 R X |
| 3,946,774 | 3/1976 | McCord, Jr. | 144/136 R X |

*Primary Examiner*—Othell M. Simpson
*Assistant Examiner*—W. D. Bray
*Attorney, Agent, or Firm*—Rogers, Bereskin & Parr

[57] ABSTRACT

A method and apparatus is shown for cutting logs into lumber by first cutting the logs into elongated wedge-shaped segments and then cutting the segments into boards. A pair of opposed spaced-apart chucks grip the ends of the log, and a saw mounted on a carriage makes longitudinal and radial cuts approximately to the center line of the log. The log is rotated incrementally by the chucks between cuts to produce the wedge-shaped segments. After all cuts have been made, the chucks release the segments and the segments are then resawn into boards.

10 Claims, 7 Drawing Figures

16
54
52
116
112
140
128
124
126
120
50
122
148
164
130
132
138
134
136
160
156
158
162
166
44
102
96
4
114
150
24
C
42
46
151
118
110
144
146
142
48

METHOD AND APPARATUS FOR CUTTING WOOD

This invention relates to a method and apparatus for cutting logs into lumber by cutting the logs into elongated wedge-shaped segments, which are subsequently resawn into boards or the like.

In certain types of timber, such as cedar, the center or heart of the log is usually decayed. This decay generally follows one of the annular growth rings, so that when the log is viewed in cross-section there is an annular ring of sound wood adjacent to the bark. The annular growth ring demarcating the decayed core of the log from the sound wood generally follows the bark line of the log so that the sound wood ring generally is of uniform thickness even although the log may be tapered. This type of log is commonly referred to as a decadent log and typically has as much as 50% sound wood in the outer annular sound wood ring.

Decadent logs usually cannot efficiently be sawn into lumber using conventional headrig sawing apparatus, because the logs are too fragile and fall apart or collapse after one or two saw cuts have been made. As a result, this type of log has been shunned by the forest industry and a great deal of timber has been wasted by leaving the felled decadent logs to be burned after the sound wood has been taken from the forest. In fact, where a forest contains a high proportion of decadent logs, the timber may not be harvested at all and the forest may be destroyed by natural causes such as decay or forest fire.

Although decadent logs cannot efficiently be cut into lumber using conventional sawing equipment, some of these logs can and have been cut into lumber in the past. A method that has been used is to split or saw the logs longitudinally to form elongated segments which are generally triangular in cross-section. The decayed heart portion is then split off and the segment is sawn into lumber. A difficulty with this method as used in the past is that it was usually necessary to cut and remove the segments individually and manually, so that the log would not collapse before all the segments were cut. Even then the logs often collapsed before all segments were cut, unless the logs were of particularly high quality. Further, it was usually not possible to obtain more than three or four segments without having the log collapse or the saw bind while cutting.

In the present invention, the chance of the decadent log collapsing while being cut is substantially reduced, so that this type of log may be effectively cut into lumber. The present invention may also be used on completely sound logs making it efficient to harvest a forest with a substantial decadent log content.

According to one aspect of the invention there is provided a method of cutting a log into lumber, which method comprises gripping the log at opposed end portions and cutting the log radially and longitudinally to form a plurality of wedge-shaped elongated segments. The segments are released after all the cuts have been made.

According to another aspect of the invention there is provided apparatus for cutting a log into lumber. The apparatus comprises a pair of opposed spaced-apart chucks adapted to hold a log longitudinally therebetween by engaging adjacent end portions of the log, and means operatively coupled to the chucks for causing the chucks to grip and release the log. A saw is located adjacent to the chucks and is adapted to engage and cut the log radially. Carriage means is operatively coupled to one of the saw and the chucks for producing relative longitudinal movement between the saw and the log to cut the log longitudinally while being cut radially. Also, rotational means is operatively coupled to one of the saw and the chucks for producing relative angular rotational movement between the saw and the log between said cuts, so that the log is cut into elongated wedge-shaped segments by rotating the log between said cuts.

A preferred embodiment of the invention will now be described, by way of example, with reference to the accompanying drawings in which.

Figure 1:
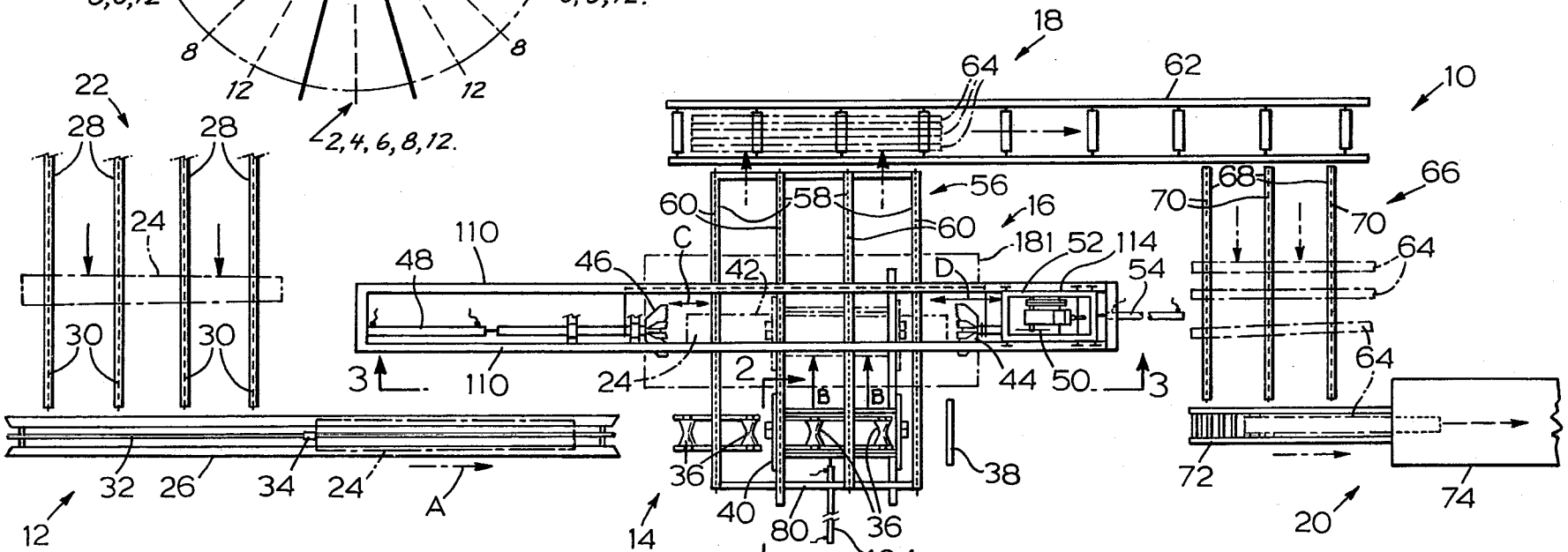
FIG. 1 is a plan view of a portion of a lumber mill layout for segment sawing logs.

Referring firstly to FIG. 1, a portion of a preferred embodiment of a saw mill layout is generally indicated by reference numeral 10. Saw mill 10 includes log feeding apparatus 12 which feeds logs cut to a predetermined desired length to a saw charging station 14. Charging station 14 transports and positions the logs in segment sawing apparatus 16 where the logs are cut radially and longitudinally into a plurality of wedge-shaped segments. These segments are then removed from the sawing apparatus by log discharging apparatus 18, which transports the segments to a resawing station generally indicated by reference numeral 20, where the segments are trimmed and resawn into boards.

The log feeding apparatus 12 includes a conventional log infeed deck 22 which receives logs already cut to the desired length using conventional equipment, and transports the logs (one log 24 being represented by chain dotted lines) to a charging conveyor 26. Logs 24 typically vary from 12 to 16 feet in length, and from 8 to 48 inches in diameter. Infeed deck 22 typically includes 4 elongated chain conveyor members 28 which have sprocket driven chains 30 (indicated by dotted lines) for transporting logs 24 to charging conveyor 26. The structural apparatus used for log infeed deck 22 is conventional and therefore will not be described in detail.

Charging conveyor 26 transports logs 24 one at a time to saw charging station 14. Charging conveyor 26 also is conventional and includes a sprocket driven chain 32 having projections 34 for engaging the end portion of log 24 and driving the log in the direction of arrow A.

Saw charging station 14 includes four hourglass rollers 36 over which log 24 travels until the log hits a stop 38. A charging carriage or sawcharger 40 then picks up the log and moves the log in the direction of arrows B until the log is in position in the segment sawing apparatus 16, as indicated by chain dotted line 42. The log is then gripped and held in sawing apparatus 16 by chucks 44, 46, at which time saw charger 40 retracts and returns to its starting position under the hourglass rollers 36 in order to received and transport another log 24.

Segment sawing apparatus 16 includes a pair of opposed chucks 44, 46 which are driven by rotational drive means as will be described further below.

Chuck 44, which may be referred to as the fixed chuck, does not move axially or longitudinally relative to log 24, whereas chuck 46, which may be referred to as the moving chuck, reciprocates as indicated by arrow C. Chuck 46 is driven toward log 24 by a hydraulic or pneumatic cylinder 48 until chuck 46 engages the adjacent end portion of log 24. The log is then further driven toward chuck 44 until this latter chuck engages its adjacent end portion of log 24. Chucks 44, 46 penetrate the respective end portions of log 24 to hold the log in position while being sawn and to rotate the log between saw cuts. The saw cuts are made using a saw 50 mounted on a saw carriage 52 which is moved longitudinally with respect to log 24 as indicated by arrow D. Saw carriage 52 is moved by a hydraulic actuator or cylinder 54, the log being rotated by chucks 44, 46 between each longitudinal cutting pass of saw carriage 52 until the log is cut into wedge-shaped segments as will be described further below.

When log 24 has been cut into segments, movable chuck 46 is retracted or withdrawn causing the log segments to drop onto a segment discharge deck 56 which is part of log discharging apparatus 18. Discharge deck 56 is similar to log infeed deck 22 and it includes 4 elongated chain conveyor members 58 having sprocket driven chains 60 (shown in dotted lines) for transporting the log segments. Again, segment discharge deck 56 is conventional lumber mill apparatus and will not be described in further detail at the present time.

The log segments are discharged from the discharge deck 56 onto a roller conveyor 62 which transports the segments (indicated by reference numeral 64) to a segment feeding deck 66. Conventional apparatus (not shown) is used to transfer segments 64 from roller conveyor 62 to segment feeding deck 66. Again, feeding deck 66 is a conventional structure formed by three chain conveyor members 68 having sprocket driven chains 70 (shown in dotted lines) to transport the segments to resawing station 20.

Resawing station 20 includes a belt or plate type conveyor 72, which transports the log segments 64 one at a time to a top and bottom flattener 74, the function of which will be described more fully below. Once the log segments 64 leave top and bottom flattener 74, the segments are edged and resawn into boards in a conventional manner which will not be described in further detail in the present specification.

Figure 2:
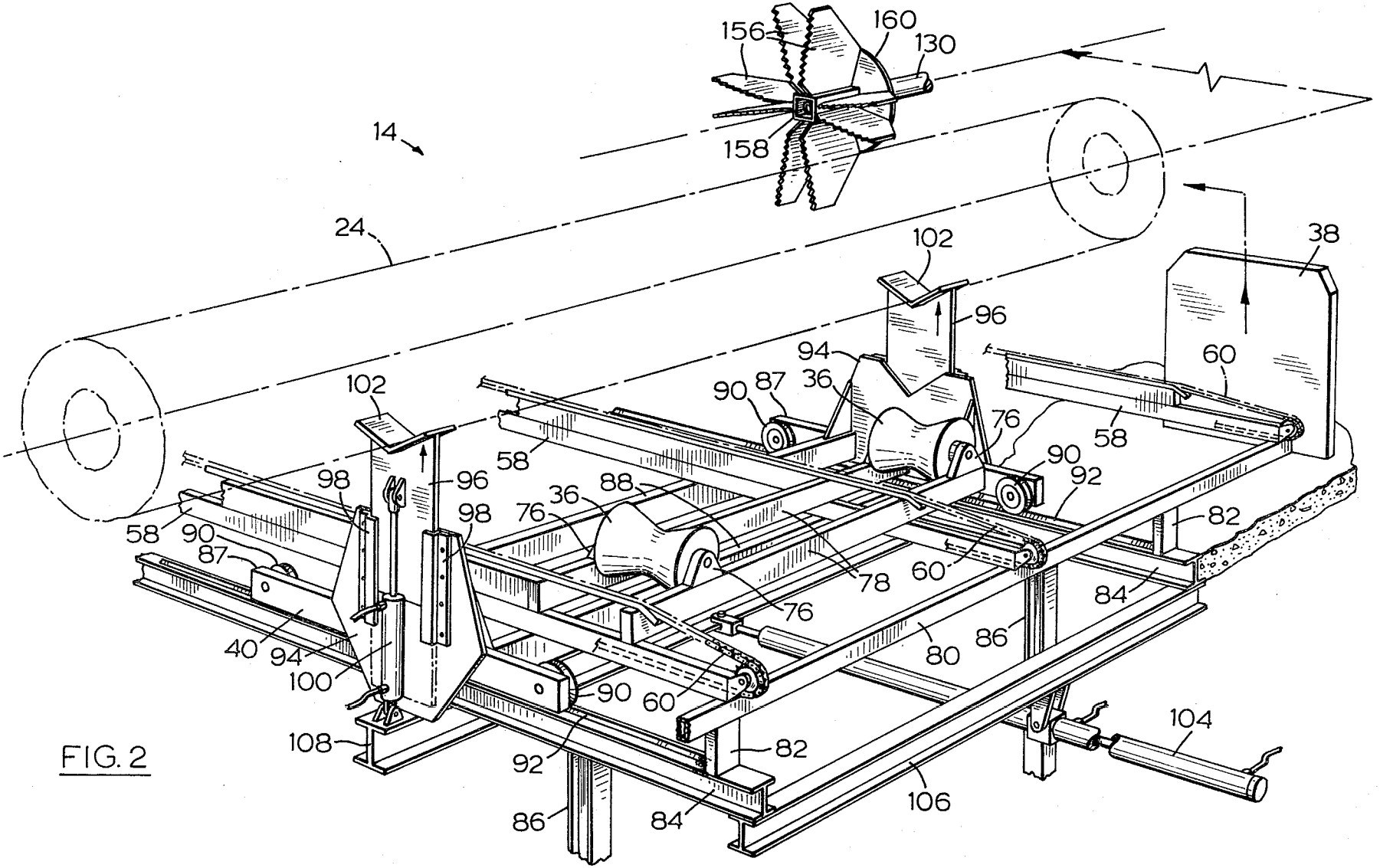
FIG. 2 is a perspective view of a saw charger and is taken generally along lines 2—2 of FIG. 1.

Referring next to FIG. 2 the saw charging station 14 and saw charger 40 will now be described in further detail. As stated above, charging station 14 includes hourglass rollers 36, two of which are shown in FIG. 2. Rollers 36 are mounted in bearing blocks 76 which are attached to a pair of transverse rails 78. Rails 78 are mounted on elongated chain conveyor members 58 which form part of the segment discharge deck 56. Chain conveyor members 58 are supported by a transverse box channel member 80, which is in turn supported by upright members 82. Upright members 82 are attached to H-beams 84 which form part of the floor structure on which charging station 14 is located. The floor H-beams 84 are supported by columns 86 in a conventional manner.

As mentioned above, charging station 14 includes a charging carriage assembly or saw charger 40 for lifting and transporting the log 24 to segment sawing apparatus 16. Saw charger 40 includes a frame having side members 87 and transverse member 88 extending therebetween. V-groove wheels 90 are rotatably attached to side members 87 and run on rails 92 to guide saw charger 40 in its reciprocating movement. Saw charger 40 also has rigid end plates 94 which include vertical sliding members 96 slidably mounted in guideways 98. Sliding members 96 are moved up and down by hydraulic actuators 100 which are operated independently as described further below. Sliding members 96 also have upper shoes 102 which permit log 24 to slide longitudinally while being supported by vertical sliding members 96. Finally, saw charger 40 is moved back and forth by a further hydraulic actuator 104 which is coupled between a transverse H-beam 106 attached to floor beams 84 and a saw charger H-beam 108 attached to the two end plates 94. The stroke of actuator 104 is approximately 6 feet in the preferred embodiment.

When a log 24 enters charging station 14, saw charger 40 is in the extreme right position and vertical upright members 96 are retracted. The upper surfaces of hourglass rollers 36 are then located above shoes 102 and chain conveyor members 58, so that log 24 can roll onto the hourglass rollers 36 and abut against stop 38. Actuators 100 are then activated or operated to raise vertical sliding members 96 and lift log 24 off hourglass rollers 36. Actuator 104 is then activated to move the charging carriage or saw charger 40 to the left toward sawing apparatus 16.

Figures 3, 4:
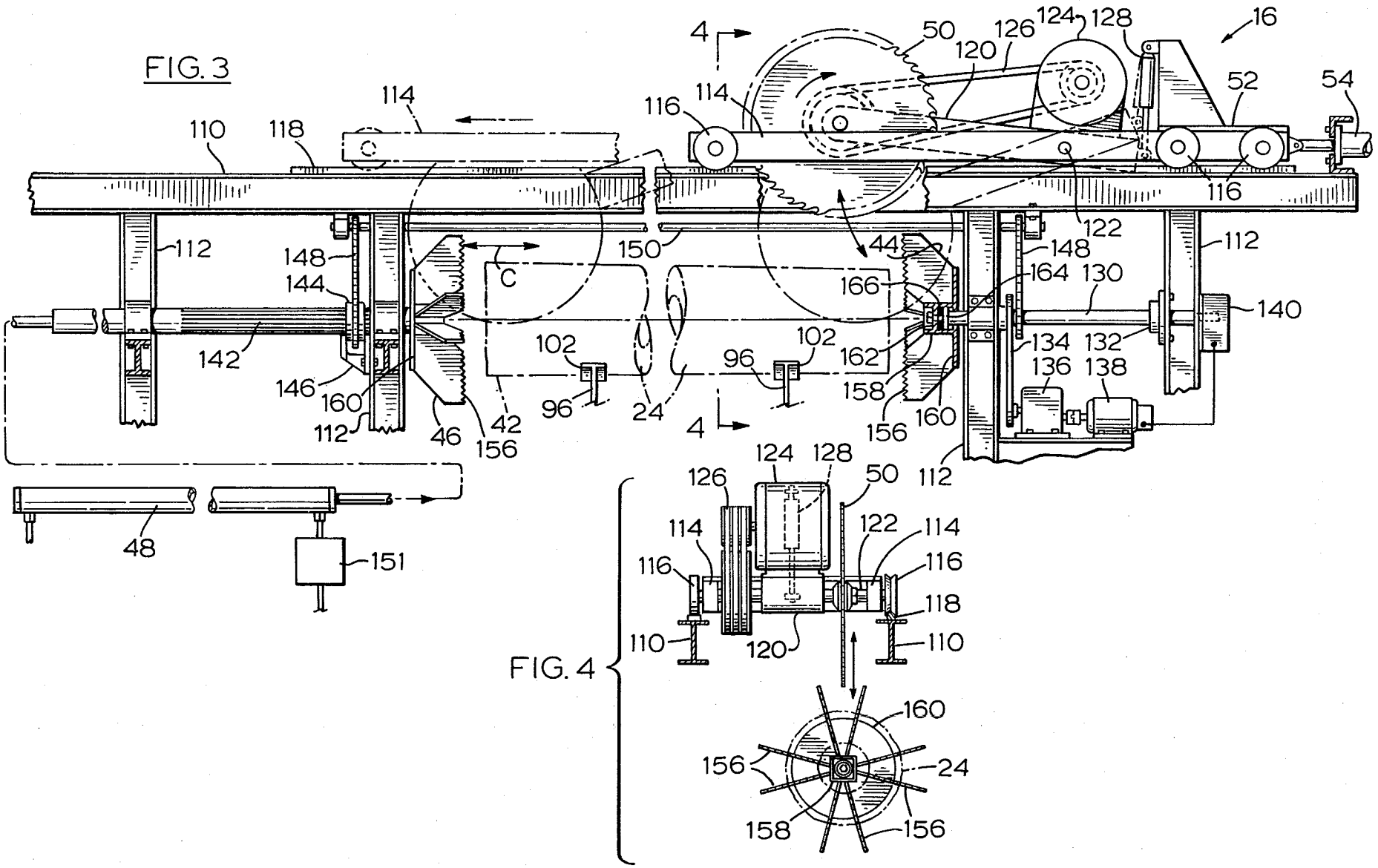
FIG. 3 is a front view of the segment sawing apparatus and is taken along lines 3—3 of FIG. 1.
FIG. 4 is a partial side view taken along lines 4—4 of FIG. 3.

Referring next to FIGS. 3 and 4, segment sawing apparatus 16 will now be described in further detail. Saw carriage 52 is mounted on a pair of horizontal rails 110 which are supported by upright H-beams 112. Saw carriage 52 includes side members 114 and wheels 116 are rotatably attached to side members 114. The wheels 116 on the right side of saw carriage 52 as seen in FIG. 4 are V-groove wheels and travel on inverted V-shaped tracks 118 to guide the saw carriage. Saw 50 is mounted on saw carriage 52 and includes a frame member 120 pivotally connected to side members 114 by a pivot pin 122. Saw 50 also includes a motor 124 and drive belts and pulleys 126. Saw frame member 120 is pivoted between the position shown in full lines and the position shown in chain dotted lines in the right hand portion of FIG. 3, by a hydraulic actuator or cylinder 128.

As mentioned above, sawing apparatus 16 also includes chucks 44, 46 for gripping log 24. Fixed chuck 44 is mounted on a rotatable shaft 130 which is prevented from moving axially by a thrust bearing 132. Shaft 130 is rotated or driven by a chain and sprocket assembly 134, which in turn is coupled to a gear box 136 and a motor 138. Motor 138 is of the incremental type and is controlled by a sensing device 140 sensitive to the position of shaft 130, so that chuck 44 may be incrementally positioned or rotated during the cutting of log 24.

Moving chuck 46 is mounted on a sliding splined shaft 142 for reciprocating movement as indicated by arrow C. Splined shaft 142 is rotated by a sliding sprocket 144 which is held in position by a yoke 146. Since shaft 142 rotates as well as reciprocates, cylinder 48 is coupled to shaft 142 by a swivel type coupling or joint (not shown), so that the piston of cylinder 48 does not also rotate. Sliding sprocket 144 is coupled to the driven rotatable shaft 130 by chains 148 and a crossover drive shaft 150, so that rotational movement of chuck 46 is in synchronization with chuck 44.

The reciprocating movement of splined shaft 142 is controlled by controlling the pressure and direction of flow of hydraulic or pneumatic fluid supplied to cylinder 48. Suitable controlling apparatus 151 is coupled to cylinder 48 for this purpose. The fluid pressure applied to cylinder 48 determines the pressure chuck 46 exerts against the end of log 24 during the gripping of log 24. This chuck pressure in turn determines the amount chucks 44, 46 penetrate into the end of log 24. In order to prevent chucks 44, 46 from penetrating too far into log 24 and possibly splitting the log longitudinally (which is only likely to occur where log 24 is particularly soft or of poor quality), the hydraulic or pneumatic pressure to cylinder 48 is levelled off or decreased slightly to prevent further chuck movement when the desired amount of chuck penetration is obtained. The fluid pressure to cylinder 48 typically ranges from 50 to 250 pounds per square inch depending upon the hardness of log 24.

Figure 5:
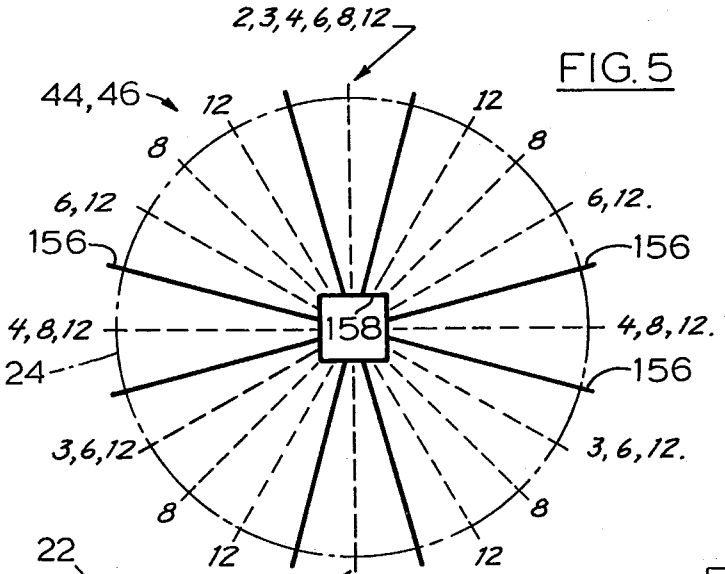
FIG. 5 is a diagramatic view of a chuck showing various log sawing configurations.

As seen best in FIGS. 3 to 5, chucks 44, 46 have eight radially spaced-apart and extending serrated blades or projections 156 attached to a square hub portion 158 and a circular backing plate 160. Located inside the square hub 158 and attached to the sides thereof is a transverse member 162 (see FIG. 3). A bolt passes through transverse member 162 and into a square seat member 164 attached to shaft 130. Square seat member 164 prevents rotation of chucks 44, 46 relative to the respective shafts 130, 142. An elastic spacer 166 is located between transverse member 162 and seat member 164 to enable chucks 44, 46 to pivot slightly to accomodate or align with the end portions of log 24 if these end portions are not cut squarely.

The operation of segment sawing apparatus 16 commences when saw charger 40 raises a log 24 into the position shown in chain dotted lines in FIG. 3. As mentioned above, actuators 100 (see FIG. 2) which raise vertical sliding members 96 are operated independently. This allows the respective end portions of log 24 to be aligned vertically so that the axis of log 24 approximately corresponds to the axes of chucks 44, 46. Actuators 100, and thus the vertical position of the respective end portions of log 24 are controlled by any conventional sensing apparatus (not shown) which stops the vertical movement of vertical sliding members 96 when the log reaches the desired position. For example, a mechanical or optical sensor may be used that senses the top and bottom surfaces of log 24 and provides a control signal when the surfaces are of equal vertical distance from the axes of the chucks.

When log 24 is in position, moving chuck 46 is moved to the right as shown in FIG. 3 and engages the adjacent end portion of log 24. Further movement of chuck 46 pushes log 24 against chuck 44, and still further movement causes the blades 156 of chucks 44, 46 to penetrate the respective end portions of log 24 at angularly spaced-apart intervals. Blades 156 penetrate approximately one fourth to one half inch into the adjacent end portions of log 24, at which time hydraulic or pneumatic pressure to cylinder 48 is levelled off or decreased slightly to prevent possible splitting of log 24. When log 24 is thus gripped by chucks 44, 46 the vertical sliding members 96 of saw carriage 40 are retracted and the saw charger is returned to pick up another log from charging conveyor 26.

With log 24 being gripped by chucks 44, 46, saw 50 is lowered and the saw is moved to the left as shown in FIG. 3 by cylinder 54. This causes saw 50 to make a radial and longitudinal cut in log 24 approximately to the center line of the log. It will be appreciated that the radial extending blades 156 of chucks 44, 46 permit saw 50 to pass therebetween so that the saw cut is made the full length of log 24. When saw carriage 52 reaches the left position as shown in chain dotted lines in FIG. 3, the first cut is finished, saw 50 is moved upwardly or retracted by actuator 128 and the saw is returned to the right hand starting position by cylinder 54. The speed of travel of saw carriage 52 is controlled by controlling the speed of cylinder 54, the left movement or cutting pass of saw carriage 52 being chosen to suit the type of wood being cut. A typical speed for the cutting pass is 300 feet per minute. The speed of return of saw carriage 52 may be faster than the speed of the cutting pass by appropriately controlling the fluid pressure to cylinder 54 as will be apparent to those skilled in the art.

After the first cut has been made, and with saw 50 raised, chucks 44, 46 are rotated by incremental motor 138 to rotate and position log 24 for second and subsequent cuts as will be described further below. However, it will be appreciated that as each of the second and subsequent cuts is made a wedge-shaped elongated segment will be formed. Also, chucks 44, 46 hold all of the segments together until the log is completely sawn. When all of the desired cuts have been made, movable chuck 46 is retracted by cylinder 48 and these segments drop onto the segment discharge deck as discussed above.

It will be appreciated by those skilled in the art that the amount of rotation of chucks 44, 46 between cuts, and thus the number of segments cut out of log 24, may be controlled automatically in a conventional manner using incremental motor 138 and sensing device 140. The number of segments desired will depend upon the size and type of log being cut as described next below.

Figure 7:
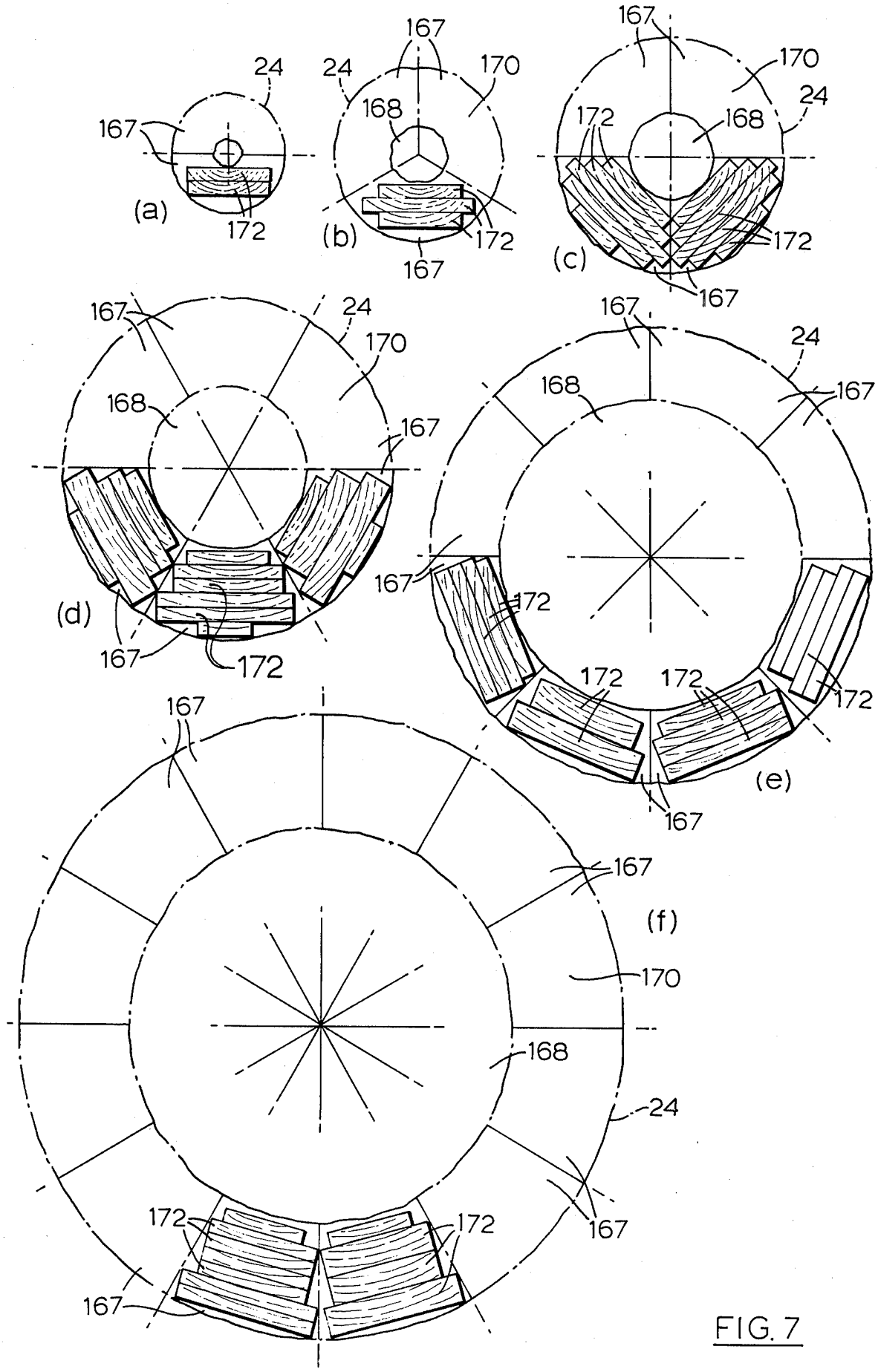
FIG. 7 comprises several diagramatic sectional views of logs illustrating various segment sawing configurations for different sized logs.

Referring next to FIGS. 5 and 7, various possible configurations of wedge-shaped segments to be cut from a log 24 are illustrated. FIG. 5 is a side view of one of the chucks 44, 46 as superimposed on an end face or end portion of a log 24. The preferred cutting lines are indicated by dotted lines and the numerals located around the periphery of log 24 indicate the number of segments being cut when the saw cuts are made on all of the particular dotted cutting lines bearing that number. For example, if the upper vertical dotted line is the starting cut and six segments are desired, subsequent cuts will be made at 60°, 120°, 180°, 240°, and 300° rotation about the axis of log 24. Similarly, if twelve segments are desired, cuts will be made at 30° intervals where the numeral 12 appears on the periphery of log 24 in FIG. 5.

FIG. 7 illustrates various sizes of logs 24 (cross-sectional views of the logs) and various choices of the number of segments of flitches 167 into which the log may be cut. The logs 24 shown in FIG. 7 are of the decadent type, that is, logs 24 have a decayed heart or center core 168 and an annular outer sound wood ring 170. The thickness of the sound wood ring 170 is measured radially from the inside diameter of ring 170 to the outside diameter of ring 170 and typically varies from 4 to 8 inches. It will be apparent that the number of segments into which logs 24 are cut is usually proportional to the outside diameter of the log. However, the number of segments also depends upon the thickness of the sound wood ring 170 and the size of the lumber desired to be produced from logs 24.

As mentioned above, segments 167 are resawn into lumber in resawing station 20 (FIG. 1). The size of the lumber or boards produced during this resawing operation may vary depending upon the purchase orders received by the saw mill, but the most common sized boards are nominally one inch or two inches thick and between 2 inches and 10 inches in width. FIG. 7 shows various nominally sized boards 172 which may be cut from segments 167. It will be appreciated that for any given diameter of log 24, a decrease in the number of segments will result in an increase in the possible width of the boards produced. As the diameter of log 24 increases, the number of segments may be increased without decreasing the width of the boards produced, because the width of segments 167 also increases. It will also be appreciated that the actual board measure obtained from a segment 167 will depend upon the thickness and width of the segment as well as the size of the boards desired.

It will be apparent to those skilled in the art that a relationship could be derived between the outside diameter of log 24, the thickness of sound wood ring 170 and the number of segments 167 which should be cut from log 24 to produce the maximum board measure obtainable from log 24. The maximum board measure obtainable would depend, of course, on the size of the boards 172 desired and whether it is desirable to obtain a mixture of boards of different widths and thicknesses from each segment 167, or boards of a constant nominal thickness or width from each segment. The mixture of board sizes probably would result in higher board measure from log 24, but this may require fairly complicated resaw equipment in resawing station 20, especially if different thicknesses of boards are to be produced from the same segment 167. The following chart illustrates typical sizes of logs 24 as shown in FIG. 7 and typical numbers of segments into which these logs are cut to produce boards 172 as shown in FIG. 7.

| | | Typical Sound Wood Dimensions in Inches | |
|---|---|---|---|
| Figure | No. of Segments | Diameter | Thickness |
| 7(a) | 2 | 8 | 3.5 |
| 7(b) | 3 | 12 | 4 |
| 7(c) | 4 | 16 | 5 |
| 7(d) | 6 | 24 | 6 |
| 7(e) | 8 | 32 | 5 |
| 7(f) | 12 | 44 | 8 |

Figure 6:
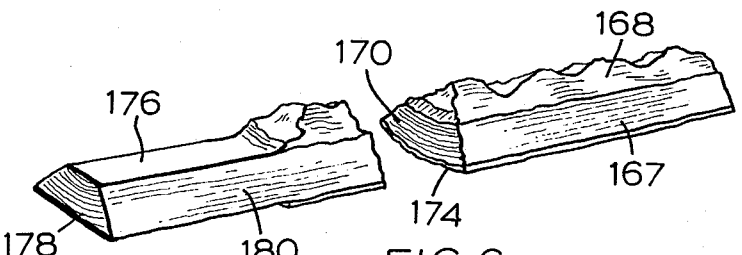
FIG. 6 is a perspective view of a log segment which has been partly processed after being cut from the log.

Referring finally to FIG. 6, a typical wedge-shaped segment or flitch 167 is shown. This segment 167 has a portion of inner decayed core 168, a sound wood section 170 and bark 174. When segment 167 enters resawing station 20, the segment is first passed through a top and bottom flattener 74 where the decayed portion 168 is planed off to form a generally flat top surface 176, and then most of the bark 174 is planed off to form a generally flat bottom surface 178. This results in a generally flat segment or flitch 180 which then passes through conventional edging and resawing apparatus to produce the desired lumber or boards.

To summarize the operation of saw mill 10 (FIG. 1), logs 24 are cut to length and are then fed from a log infeed deck 22 to a charging conveyor 26 and then into the saw charging station 14 to come to rest against stop 38. Saw charger 40 then picks up and transports the log 24 to the segment sawing apparatus 16, where the log is aligned by the saw charger and gripped by chucks 44, 46. The saw charger 40 is retracted and returned to receive another log, and saw carriage 52 is activated to commence sawing the log into segments. When all of the segments have been cut as desired, chuck 46 is retracted and the segments drop onto segment discharge deck 56. When the segments drop onto discharge deck 56, most of the decayed core portion of the segments will break off and fall to the floor. For this reason, an opening 181 is formed in the floor and a bin is placed below the opening to catch and dispose of this decayed core matter. The segments are transferred from discharge deck 56 to roller conveyor 62 and then onto segment feeding deck 66 and plate conveyor 72. The segments are then flattened and resawn into lumber as described above.

Having described a preferred embodiment of the invention, it will be appreciated that many variations could be made to the method and apparatus described above. For example, a different type of chuck could be used to grip the end portions of the log. A chuck having fewer or more blades 156 could be used if it were desirable to change the possible number of segments into which the log could be cut. It is also possible to rearrange the blades to accomodate different numbers of segments if desired. Finally, the blades could be replaced with another type of projecting members, such as angularly spaced apart spikes, or an altogether different type of chuck could be used providing it does not damage or smash the end portion of the log.

Although logs 24 have been shown to be cut into equal sized segments, log 24 could be cut into different sized segments if desired. However, since the logs entering the segment sawing apparatus are likely to vary considerably in size, it is preferable to keep the relative size of the segments generally constant for each log to simplify the control or number of cutting modes that could be selected for each log. In this connection, before any cuts are made an operator approximately measures the diameter of the log and the thickness of the sound wood ring, and depending on the size of boards ultimately to be produced, the operator selects the number of segments into which the log is to be cut. The saw carriage is then operated to make the required longitudinal and radial cuts in the log to produce the number of segments selected.

Rather than having saw carriage 52 move relative to the log, it is possible to provide a carriage for moving the log relative to the saw. Similarly, the saw carriage could be rotated relative to the log rather than rotating the log relative to the saw. Also, a plurality of saws 50 could be provided to make some of all of the cuts simultaneously and speed up the production of segments. However, these alternatives would likely be rather cumbersome and expensive to manufacture and are therefore not preferred.

In regard to the incremental rotation of the log to produce the desired number of segments, motor 138 and sensor 140 could be replaced by other apparatus for sensing the position of the chucks and incrementally rotating the chucks between cuts. For example, a brake and clutch assembly could be used in connection with the chuck drive to position the chucks. Further, conventional apparatus could be used to automatically incrementally rotate the log and operate the saw carriage once the number of segments desired has been selected.

It will be appreciated that lumber or boards can be cut from the flattened segments or flitches 167 in any conventional manner, such as by using horizontal saws or vertical saws, so that the boards are produced having either flat grain or vertical grain as desired. Of course, the sound wood flitches 167 do not necessarily have to be cut into boards if this is not desirable. They could be used as is for lumber such as posts or the like.

Although the above invention has been described as being used primarily for the milling of decandent logs, such as cedar, it will be appreciated that this invention could be used in connection with other woods such as cottonwood or hemlock, if the quality of the hemlock is not extremely bad. Further, the invention may be and usually is used for sawing completely sound logs, since these sound logs are often mixed with the decandent logs in a forest. The segment sawing method often produces more board measure from even a sound log than conventional sawing methods, especially where the sound log has a substantial taper. However, the present segment sawing method is particularly advantageous for decadent logs, since the sound wood portion of these logs cannot efficiently be recovered using conventional apparatus.

What I claim as my invention is:

1. A method of cutting a log into lumber comprising: gripping opposed end portions of the log at a plurality of spaced-apart intervals by longitudinally compressing the log between a pair of opposed chucks, the chucks having radially extending blades for gripping the log; cutting the log radially and longitudinally between said spaced-apart intervals to form a plurality of wedge-shaped elongated segments; holding the segments at said spaced-apart intervals with said chuck blades to prevent relative movement between the segments; and releasing the segments after all said cuts have been made.

2. The method as claimed in claim 1 wherein the log is cut by incrementally angularly rotating the log between successive longitudinal and radial cuts, and wherein said rotation is produced by rotating the chucks.

3. The method as claimed in claim 2 and further comprising the step of resawing the segments into boards after the segments have been released.

4. Apparatus for cutting a log into lumber, the apparatus comprising:

a. a pair of opposed spaced-apart chucks adapted to hold a log longitudinally therebetween by engaging adjacent end portions of the log;

b. means operatively coupled to the chucks for causing the chucks to grip and release the log;

c. a saw located adjacent to the chucks and adapted to engage and cut the log radially;

d. carriage means operatively coupled to one of the saw and the chucks for producing relative longitudinal movement between the saw and the log to cut the log longitudinally while being cut radially;

e. rotational means operatively coupled to one of the saw and the chucks for producing relative angular rotational movement between the saw and the log between said cuts, so that the log is cut into elongated wedge-shaped segments by rotating the log between said cuts; and f. the chucks including a plurality of projections in the form of radially extending angularly spaced-apart blades adapted to partially penetrate the segment ends to prevent relative movement therebetween, thereby permitting the saw to pass partially through the chucks to complete the longitudinal cuts in the log.

5. Apparatus as claimed in claim 4 wherein the carriage means is coupled to the saw to move the saw longitudinally relative to the log, and wherein said rotational means is coupled to the chucks, so that rotation of the chucks causes the log to rotate relative to the saw.

6. Apparatus as claimed in claim 5 wherein the saw is adapted to cut the log radially to the central axis of the log.

7. Apparatus as claimed in claim 4 wherein said rotational means includes means for producing predetermined incremental angular movement of the log relative to the saw between cuts, the incremental angular movement being proportional to the number of segments produced from the log.

8. Apparatus as claimed in claim 5 wherein said rotational means includes means for producing predetermined incremental angular movement of the log relative to the saw between cuts, the incremental angular movement being proportional to the number of segments produced from the log.

9. Apparatus as claimed in claim 8 and further comprising resawing apparatus for cutting the wedge-shaped segments into boards.

10. Apparatus for cutting a log into lumber, the apparatus comprising:

a. a pair of opposed spaced-apart chucks adapted to hold a log longitudinally therebetween by engaging adjacent end portions of the log;

b. means operatively coupled to the chucks for causing the chucks to grip and release the log;

c. a saw located adjacent to the chucks and adapted to engage and cut the log radially;

d. carriage means operatively coupled to one of the saw and the chucks for producing relative longitudinal movement between the saw and the log to cut the log longitudinally while being cut radially;

e. rotational means operatively coupled to one of the saw and the chucks for producing relative angular rotational movement between the saw and the log between said cuts, so that the log is cut into elongated wedge-shaped segments by rotating the log between said cuts;

f. the chucks including a plurality of angularly spaced-apart projections adapted to partially penetrate the segment ends to prevent relative movement therebetween; and g. the chucks including a hub having elastic spacer means located therein for enabling the chuck to pivot and align with the end portions of the log.

* * * * *